US009638504B1

(12) United States Patent
Sutherland et al.

(10) Patent No.: US 9,638,504 B1
(45) Date of Patent: May 2, 2017

(54) WARHEAD FUSE

(75) Inventors: Gerrit Sutherland, Churchville, MD (US); Harold W. Sandusky, Fulton, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 1216 days.

(21) Appl. No.: 12/924,796

(22) Filed: Sep. 23, 2010

Related U.S. Application Data

(63) Continuation-in-part of application No. 11/820,041, filed on Jun. 8, 2007, now abandoned.

(51) Int. Cl.
*F42C 15/34* (2006.01)

(52) U.S. Cl.
CPC ..... *F42C 15/34* (2013.01)

(58) Field of Classification Search
CPC ..... F42C 15/184; F42C 15/188; F42C 15/24; F42C 15/192; F42C 15/196; F42C 15/00; F42C 15/18; F42C 15/26; F42C 15/34; F42C 19/0838
USPC ..... 102/202.1, 221–222, 237, 244, 254–256, 102/231, 235, 245
See application file for complete search history.

(56) References Cited

U.S. PATENT DOCUMENTS

| | | | | |
|---|---|---|---|---|
| 2,043,266 | A * | 6/1936 | Rogers | F42C 15/18 102/237 |
| 2,465,395 | A * | 3/1949 | O'Rear | F42C 15/22 102/242 |
| 2,725,011 | A * | 11/1955 | Sundermann et al. | 102/244 |
| 3,311,058 | A * | 3/1967 | Fohrmann | F42B 3/18 102/254 |
| 3,750,589 | A * | 8/1973 | Egli et al. | 102/237 |
| 3,765,340 | A * | 10/1973 | Brothers | F42C 15/196 102/216 |
| 3,956,991 | A * | 5/1976 | Means | F42B 3/113 102/213 |
| 4,457,232 | A * | 7/1984 | Post | F42C 15/16 102/233 |
| 4,592,281 | A * | 6/1986 | Nagennast | F42C 15/18 102/200 |
| H1078 | H | 7/1992 | Norris et al. | |
| H1304 | H | 4/1994 | Norris et al. | |
| 5,526,749 | A * | 6/1996 | Teetzel | F41A 9/62 102/201 |
| 2007/0131127 | A1* | 6/2007 | Magnan | F42C 15/184 102/222 |

* cited by examiner

*Primary Examiner* — Stephen M Johnson
*Assistant Examiner* — Benjamin Gomberg
(74) *Attorney, Agent, or Firm* — Fredric J. Zimmerman

(57) ABSTRACT

A warhead fuse mechanism is used to prevent an accidental explosive event of a warhead by separating the booster lead into a plurality of booster lead segments, with each of the individual booster lead segments having a diameter less than the failure diameter of the booster lead explosive. A separating device separates the booster lead segments from each other to maintain the failure diameter until detonation is desired.

20 Claims, 7 Drawing Sheets

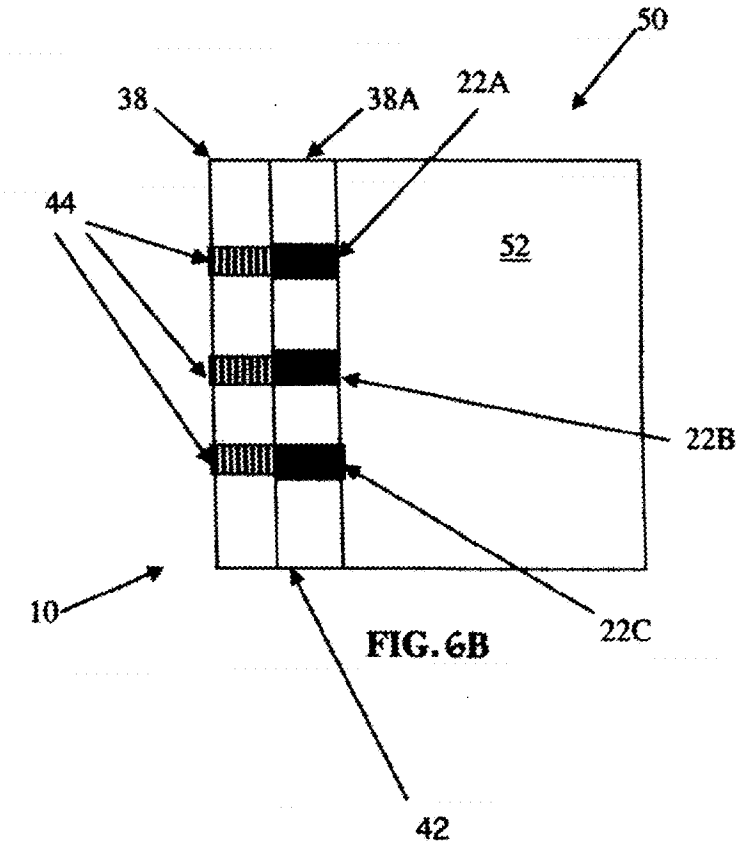
FIG. 6B
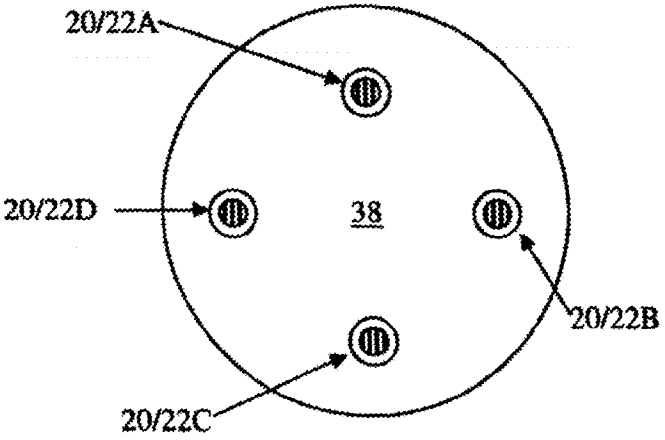
FIG. 6A
FIG. 6

WARHEAD FUSE

The present application is a Continuation-In-Part Application of prior U.S. patent application Ser. No. 11/820,041 filed on Jun. 8, 2007 now abandoned.

STATEMENT OF GOVERNMENT INTEREST

The invention described herein may be manufactured and used by or for the government of the United States of America for governmental purposes without the payment of any royalties thereon or therefor.

BACKGROUND OF THE INVENTION

1. Field of the Invention

The present invention provides a safety mechanism useful in warhead fuses that sufficiently restricts the booster lead diameter to preclude transfer of an explosive event through the booster lead thereby preventing accidental detonation of the warhead main charge.

2. Brief Description of the Related Art

Typically, conventional explosive trains include a fuze, detonator, safe/arm mechanism, booster charge, and explosive device or warhead. Current fuses such as those incorporated in general purpose bombs used by the United States Navy and Air Force contain a pellet of booster explosive to initiate the main charge explosive. The fuse pellet may be made from a primary explosive to allow a slapper or detonator to initiate the booster pellet. However, the primary explosive may be subject to an accidental detonation, such as high-speed fragment impact, cook off, or other initiating occurrence resulting from shipboard accidents or operations, mishandling, etc. With accidental detonation, the primary explosive is likely to detonate the main charge explosive. One example of a munition that suffers from the problem of accidental armed deployment is the M230/M231 fuze used on the sub-munitions of the 2.75 multi-purpose sub-munition (MPSM) Rocket Warhead. This munition contains a spring loaded (stored energy) firing pin, which can cause unintentional or accidental detonation of armed dud sub-munitions, such as the M73/M75, on the battlefield or upon accidental expulsion. Accidental explosion of sub-munitions on board United States Warships or other installations present potentially serious safety hazards to personnel, equipment and expensive weapon systems.

Safe/arm mechanisms are interposed between the detonator and booster to protect the explosive device from accidental detonation. The safe/arm mechanisms may include out-of-line methodologies whereby the detonator is separated from the booster by one or more physical barriers. Accidental detonation of the detonator can not penetrate the physical barrier and detonate the warhead. Although this method is simple and direct, it may not always prove reliable.

A number of main charge explosives are qualified as Extremely Insensitive Detonating Substances (EIDS) or 1.6S materials. EIDS materials offer less susceptibility to stimuli such as fragment attack and cook off. Nonetheless, a warhead having a detonator, fuse, and main charge explosive meeting the 1.6 standard needs fuses that are less vulnerable to fragment attack and thermal cook off.

Accordingly, there is a need in the art to provide improved safety of fuse mechanisms for explosives. The present invention addresses this and other needs.

SUMMARY OF THE INVENTION

The present invention includes a weapon system having a warhead fuse for preventing an accidental explosive event of a warhead explosive having the warhead explosive, a warhead fuse with a warhead detonator effective for detonating the warhead explosive, a plurality of booster leads with each of the booster leads having a diameter constituting less than the failure diameter of the explosive of the booster lead and a booster lead separating device to separate the plurality of booster leads from each other effective to maintain the failure diameter.

The present invention also includes a method for preventing an accidental explosive event of a warhead comprising the steps of providing a weapon system having a warhead explosive, a warhead fuse with a warhead detonator effective for detonating the warhead explosive, a plurality of booster leads with each of the booster leads having a diameter constituting less than the failure diameter of the explosive of the booster lead and a booster lead separating device to separate the plurality of booster leads from each other effective to maintain the failure diameter, and maintaining the position of the booster leads using the booster lead separating device to maintain the failure diameter within the booster leads, wherein a detonation of any of the booster leads fails to provide an energy transfer to the warhead explosive for warhead explosive detonation.

The fuse of the present invention incorporates a safety mechanism that segregates booster leads in units that are individually ineffective for conducting an explosive event. As such, accidental explosive events are unable to transfer through the booster leads. Operational or purposeful explosive events are able to transfer through the booster leads by combining the individual booster leads together to form a diameter greater than the explosive failure diameter of the particular booster lead explosive composition.

BRIEF DESCRIPTION OF THE DRAWINGS

FIG. 6 illustrates an additional exemplary embodiment of a multi-slapper booster in a safe and armed mode; and, FIG. 7 shows the steps for arming a fuse of the present invention.

DETAILED DESCRIPTION

In an exemplary embodiment, the present invention provides a safe and arming fuse system for weapon systems containing insensitive main charge explosives. The fuse mechanisms of the present invention divide booster leads into separate units that are individually ineffective for conducting an explosive event through the length of the booster lead. Segregation of the booster lead units from one another isolates these units so that the individual (booster) segments are unable to transfer or propagate an explosive event into the main charge of the warhead, that is, a "critical diameter" also referred to as a "failure diameter" is not met, and thus the diameter of each individual booster segment alone is considered too small to exceed the critical (failure) diameter.

In particular, the critical diameter must be exceeded for the system to function properly, that is, below the diameter of a specific cross-sectional area in an exemplary circular embodiment, the system will not propagate the explosive event. The critical diameter depends on or is the property of the type of explosive material itself. While the individual booster segments remain individually separated, when the fuse is subjected to conditions that would normally promote an explosive reaction through the booster lead, such as an accidental dropping, exposure to fire, etc., the explosive event is incapable of continuing through the length of the booster lead units. This configuration provides a fuse design that makes the warhead less vulnerable to thermal cookoff, mishandling, fragment attack or other such stimuli. As such, accidental detonations of the main charge do not occur while the booster lead is placed in a safe condition, i.e., the booster lead units are isolated. The weapon system may be armed to allow detonation of the main charge by combining the unitized booster leads together in a manner that increases the diameter of the combined booster leads to greater than the failure (critical) diameter of the particular type of explosive(s) constituting the booster leads, that is, the critical diameter is exceeded. Once the booster lead units are combined, the explosive event can transfer through the booster lead, ending in an operational explosive event of the main charge. Importantly, this embodiment of the invention eliminates the need for a booster pellet made of secondary explosive. When combined with a new 1.6 explosive, the present invention provides a safe arming mechanism of warheads that is less vulnerable to fragment attack and cook off. Additionally, the fuse decreases warhead vulnerability for warheads not using 1.6 explosives.

Figure 1:
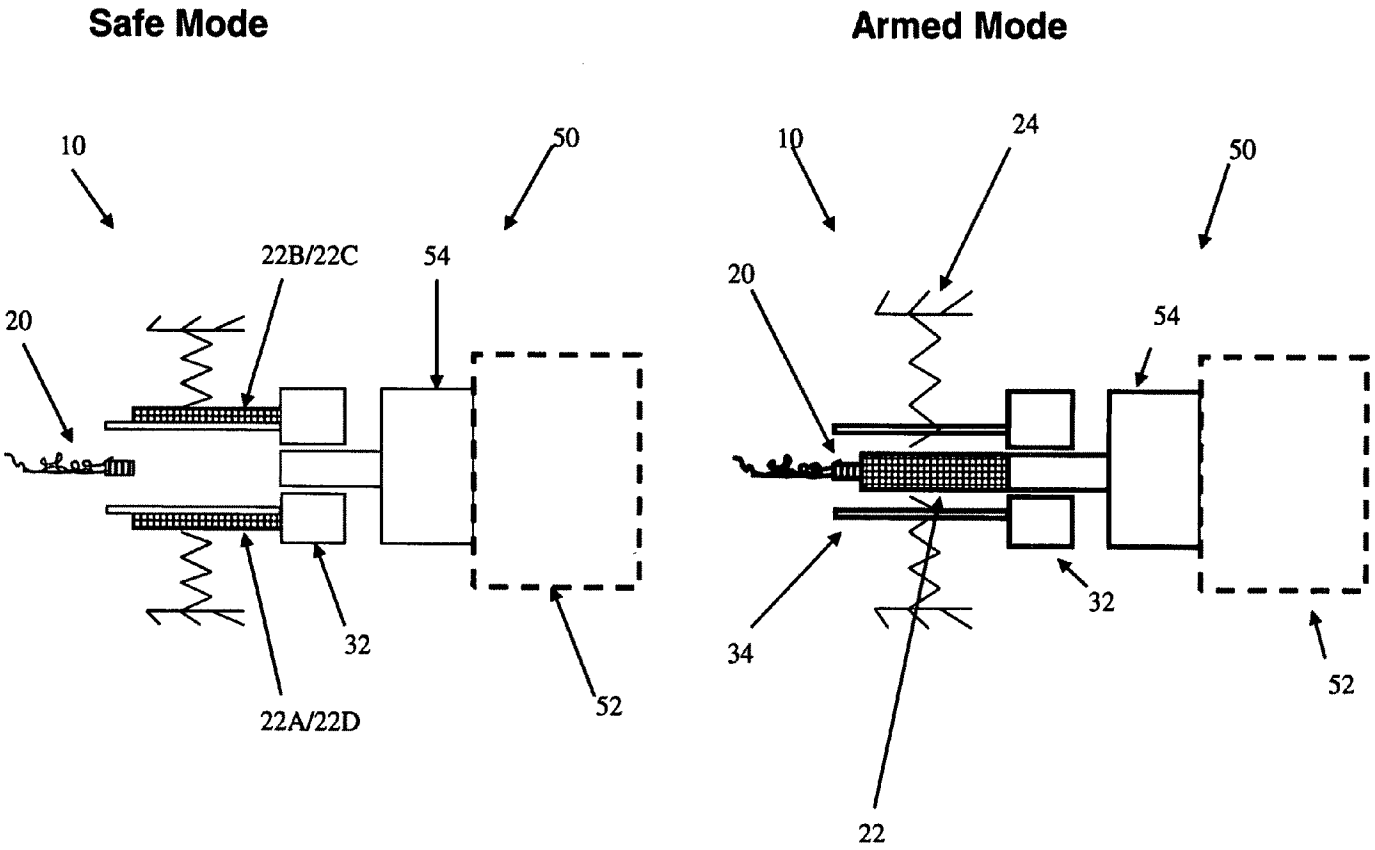
FIG. 1 illustrates a side view of a safe and armed mode of the present invention.

Referring to FIG. 1, a side view of a weapon system (not completely shown) includes a warhead fuse 10 of the present invention, showing both a safe mode and armed mode. A warhead explosive 50, along the train of the warhead fuse 10, generally includes a booster charge (or main booster charge) 52, such as PBXN-113, AFX-757 or other 1.6S materials. A preliminary booster charge 54 may be useful for initiation of the main booster charge 52. As further shown in FIG. 1, the warhead fuse 10 includes a warhead detonator 20 that is sufficiently powerful to initiate detonation of an adjacent booster lead 22 also referred to as a combined booster lead 22.

Figure 2:
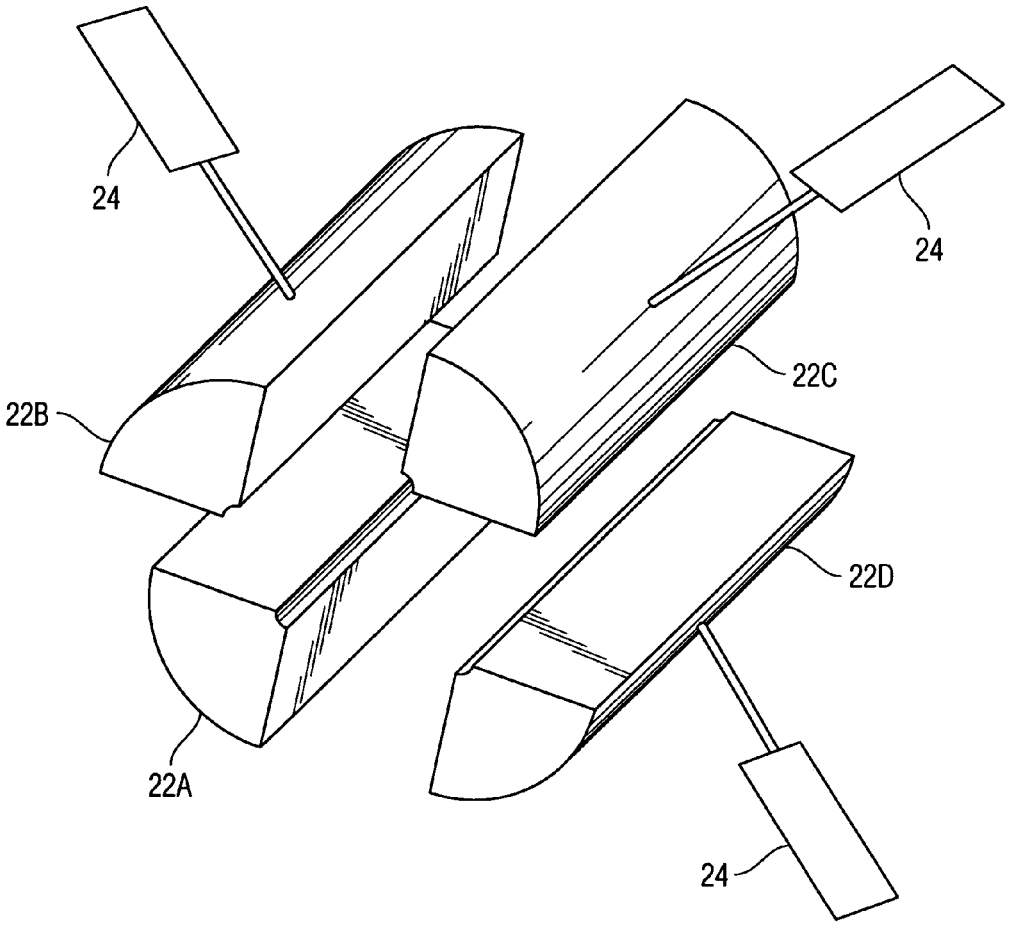
FIG. 2 illustrates a solenoid mechanism for arming the fuse system of the present invention.

As seen in the safe mode representation of FIG. 1 and in FIG. 2, the warhead fuse 10 maintains a safe condition while the combined booster lead 22 has been separated into booster lead units or individual booster (lead) segments 22A and 22B (with 22C and 22D behind, see FIG. 2). The booster lead units 22A-D are separated or isolated from each other through a separation device 24. In this configuration, each of the individual booster lead segments 22A-D, also referred to herein as the plurality of booster lead segments, of the combined booster lead 22, has a restricted diameter. The restricted diameter of each booster segment 22A-D is less than the failure (critical) diameter of the combined component booster lead explosive 22, that is, the diameter formed by combining the plurality of individual booster lead segments 22A-D. For a cylindrical explosive charge, the charge must be over a given diameter called the failure (critical) diameter for a detonation to propagate. This feature also applies to other geometries; for square stock there is a certain width (thickness) needed, etc. Failure diameter includes specified diameters of an explosive component necessary for conducting an explosive event through the length of the explosive, i.e., failure diameter is the minimum diameter of material needed to propagate a detonation wave. Failure diameter calculations are well known in the explosives art, with failure diameter ($D_f$) of a line or length of an explosive being the minimum diameter in which a steady self-sustaining detonation wave can be propagated. For diameters smaller than $D_f$, any attempt to generate such a steady wave will fail, i.e., it will result in a shockwave that quickly decays to zero strength. For example, United States Statutory Invention Registration nos. H1078 and H1304, both to Norris et al., describe the failure diameter of CL-14 for small booster and large main charge applications. A booster lead separating device 24 is used to separate and effectively isolate the individual booster lead segments 22A and 22B from each other, and/or other booster lead segments 22C, 22D, etc. of the fuse 10. The booster lead separating device 24 disperses each of the individual booster lead segments 22A-D to effectively isolate the booster lead segments 22A-D from one another to maintain the failure diameter of the booster lead segments 22A-D. Effective separation and isolation of the booster lead segments 22A-D includes having the booster lead segments 22A-D parted in a manner where an explosive event within one of the booster lead segments does not transfer into another booster lead segment to detonate the warhead explosive 50.

The number of divisions of the booster lead 22 into booster lead segments 22A-D may include any appropriate number that allows for segregating the individual booster lead segments 22A-D from each other and for controlling the individual booster lead segments 22A-D to maintain failure diameter of each unit. Representative numbers of individual booster lead segments 22A-D include, for example, from about 2 to 10 booster leads, and, for example, more particularly from about 2 to 6 booster leads, and for example, even more particularly, from about 2 to 4 booster leads. In an embodiment, the booster lead segments 22A-D are configured to longitudinally abut each other along a surface area when they are merged together. Generally, as each individual booster lead segment 22A-D abuts another individual booster lead segment, the booster lead segments 22A-D are joined along a planar surface where the abutting of the booster leads maximizes the adjoining surface area and diameter of the combined units. The individual booster lead segments 22A-D may include any appropriate configuration, such as shape configurations that include cross-sectional pie shape, square, rectangular and/or combinations thereof. In an exemplary embodiment, the booster lead segments 22A-D, individually form a pie section that together form a pie shape configuration.

The booster lead separating device 24 may include compression, tensioning and other like devices for fixing the relative position of the booster lead segments 22A-D relative to one another, with a representative tensioning device 24 for separating the individual booster lead segments 22A-D shown in FIG. 2. FIG. 2 illustrates a solenoid or piston mechanism for arming the fuse system of the present invention. Representative tensioning devices 24 include, for example, spring, piston and/or solenoid operating mechanisms configured to apply a force onto or away from the individual booster lead segments 22A-D to separate them. As seen in FIG. 2, the mechanical system of springs, pistons or solenoids force multiple booster leads 22A-D of a cap sensitive explosive together to form a combined shape, such as a cylinder (see FIGS. 2 and 3). With the booster lead segments 22A-D divided, accidental detonation within the individual booster lead units 22A-D fails to detonate the warhead explosive 50, that is, preliminary booster charge 54 and main booster charge 52, because the booster lead segments prevent the accidental explosive event from transferring an effective amount of energy through the booster lead 22 and into the warhead explosive 50. Once the booster lead segments 22A-D are combined, as shown in the armed mode of FIG. 2, the diameter of the resulting lead becomes greater than both the critical diameter of booster lead explosive and the critical diameter of a 1.6 main charge explosive. The failure diameter for a 1.6S explosive can be small and tests have shown that a detonation wave will propagate, for example, in a 0.375 inch thick square of PBXN-113 explosive. As such, a preliminary booster 54 of, for example, PBXN-113, may be used initiate the main booster charge 52 having another 1.6 explosive of still larger failure diameter.

Figure 3:
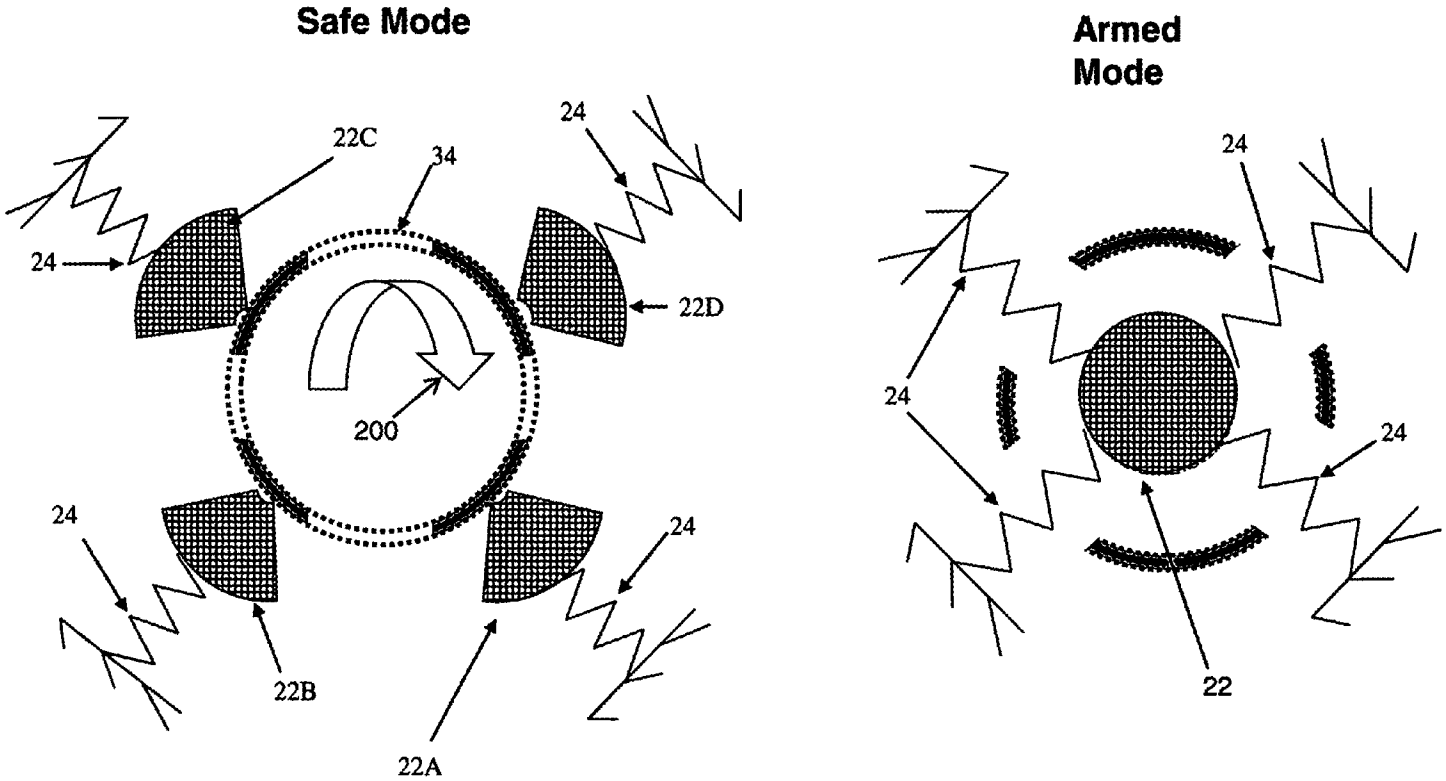
FIG. 3 illustrates an end view of a fuse having a rotating tube arming mechanism to arm the fuse of the present invention.

In an embodiment, shown in FIG. 3, the tensioning device 24 includes a spring mechanism. This configuration, and other configurations, may further include an independent merging device 34 for consolidating the booster lead segments 22A-D together, such as a rotating tubular mechanism 34 that forces the booster lead segments 22A-D together as two parts of the device are rotated relative to each other. As seen in the end view representation of FIG. 3, the fuse 10 is changed from a safe mode to an armed mode with the rotation 200 that forces the booster lead segments 22A-D to merge into the booster lead 22, having a diameter larger than the failure diameter of the composition of the booster lead 22.

Additionally, the fuse 10 may further include one or more energy absorbing material 32 between the booster lead segments 22A-D and warhead explosive 50. The energy absorbing material 32, also referred to as attenuating material, may include separate energy absorbing materials 32 present for each of the individual booster lead segments 22A-D. The attenuating material 32 (FIG. 1) may include those materials (solid, gas, liquid) used to absorb, dampen, attenuate, block, reduce, dissipate, eliminate, redirect, reflect, divert, delay, isolate, impede, or otherwise decreases effects of the shock produced by one explosive on any surrounding structure, including another explosive or another component. Representative examples include porous materials, including porous solids or liquids, being any material filled in part with compressible elements or a compressible volume (e.g., vacuum, gas, or other material). As used here, a "compressible volume" can be any volume that is filled with a compressible material or a vacuum. The attenuating characteristic of a porous material is related to its strength, density, and porosity. To achieve desirable attenuating characteristics, a material should be high density and should have a significant volume of (e.g., about 2%-90%) of highly compressible material (gas, vacuum, solid, liquid) dispersed throughout the attenuating material, preferably dispersed uniformly throughout the material. Porous liquids include aerated liquids, which are liquids in which a gaseous phase coexists with a liquid phase. Porous liquids may also be aphron-based liquids or liquids containing hollow spheres or other shells that are filled with gas or vacuum. Alternatively, the porous material may also be a solid, such as cement mixed with hollow microspheres, such as that available under the tradename LITECRETE® from Schlumberger Technology Corporation or other hollow spheres or shells, epoxy mixed with hollow spheres or shells, a honeycomb material, and any other solid filled with a certain percentage of compressible volume. For porous materials, adequate attenuating characteristics may include porosities of about 5%, 10%, 20%, 30%, etc., and the like, with proper porosities determinable by one skilled in the art through routine experimentation. In further embodiments, instead of compressible volumes to fill pores of a porous solid, a material that exhibits a phase change (referred to as a "phase change" material) may be used. Examples of phase change materials include bismuth and graphite. The attenuating material 32 protects other explosives from shock waves generated by detonation of an explosive.

Figure 7:
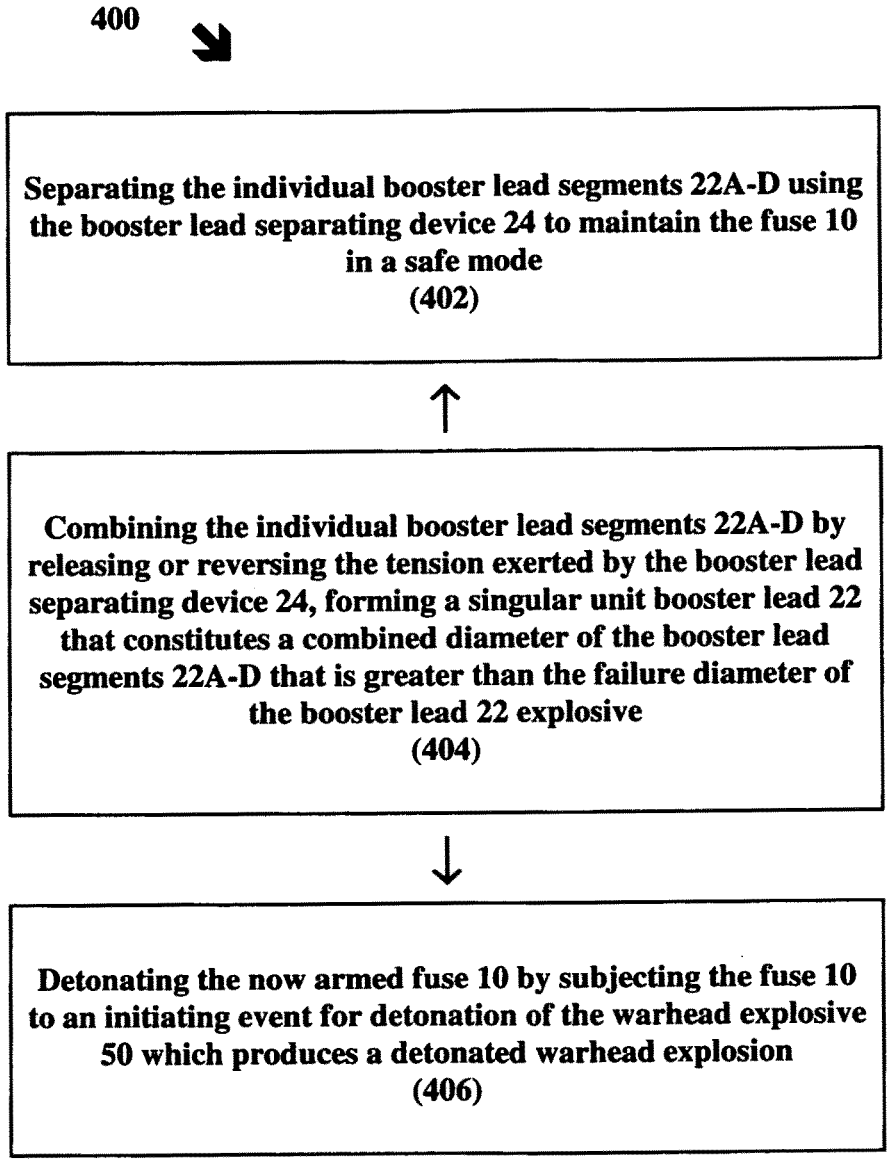

Steps for arming 400 a fuse 10 of an embodiment of the present invention are shown (see FIG. 7). Separation 402 of the individual booster lead segments 22A-D using the booster lead separating device 24 maintains the fuse 10 in a safe mode. The individual booster lead segments 22A-D are combined 404 by releasing or reversing the tension exerted by the booster lead separating device 24, forming a singular unit booster lead 22 that constitutes a combined diameter of the booster lead segments 22A-D that is greater than the failure diameter of the booster lead 22 explosive. The now armed fuse 10 may be subjected to an initiating event for detonation 406 of the warhead explosive 50 which produces a detonated warhead explosion. The individual booster lead segments 22A-D may be combined at any appropriate timing for the arming of the warhead for operational use, such as combining the plurality of booster lead segments to allow detonation to occur within time periods to maximize the safety of the weapon until detonation while allowing effective arming of the weapon. Such times may include, for example, within ten minute, five minutes, one minute, etc. of the detonation of the warhead explosive, such as 45 seconds, 30 seconds, 15 seconds, etc., and greater, intermediate or lesser times, with optimal times determinable by those skilled in the art in light of the disclosure herein considering such factors as the type of weapon, launch platform, servicing conditions and other such factors that may be applicable to safety and effective detonation of a given weapon. Accidental explosive events to a warhead 50 are prevented using the fuse 10 of the present invention and maintaining the fuse 10 in a safe mode until operational use of the weapon system is desired. By maintaining the position of the booster lead segments 22A-D using the booster lead separating device 24, thereby maintaining the diameter of each of the booster lead segments less than its corresponding failure diameter, detonation of any of the booster lead segments 22A-D fails to provide an energy transfer to the warhead explosive 50 for warhead explosive detonation.

Figure 4:
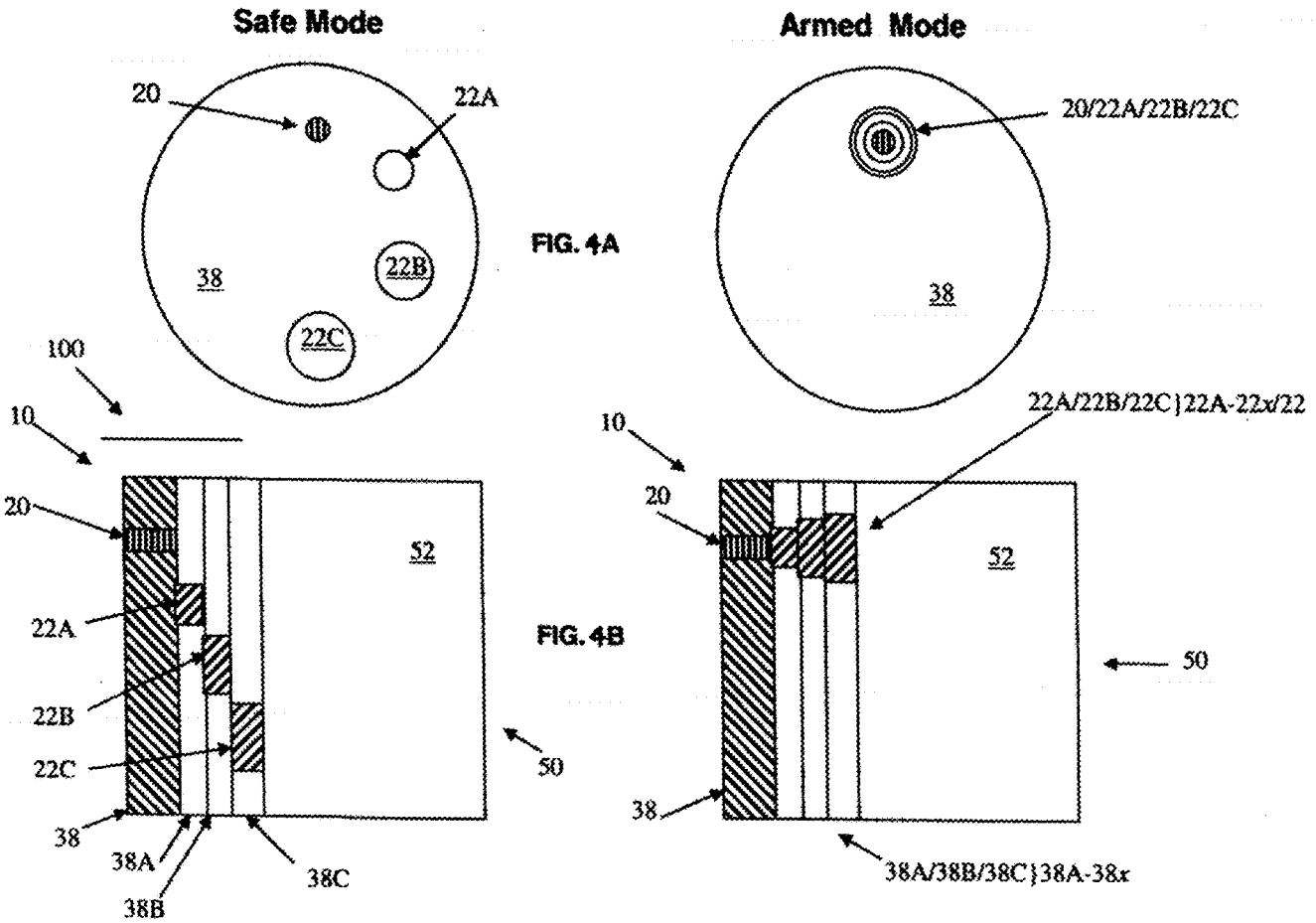
FIG. 4 illustrates an exemplary embodiment of a segmented booster in a safe and armed mode.

Another exemplary embodiment is a plurality of booster leads that are large enough in diameter to detonate but individually shorter than that required to initiate the booster charge 52. The booster segments have increasing diameter from the warhead detonator 20 with the diameter of only the last segment 38C exceeding the failure diameter of booster charge 52 for additional protection from accidental initiation of the warhead explosive 50. In the Safe Mode, as shown in FIG. 4A, the warhead detonator 20 and individual booster lead segments 22A, 22B, and 22C are in disks 38, 38A, 38 B, and 38C, respectively, that maintain each component out of line with any component preceding or following it. In the Armed Mode, as shown in FIG. 4B, the disks are rotated so that all components are in line for initiation of the booster charge 52.

Figure 5:
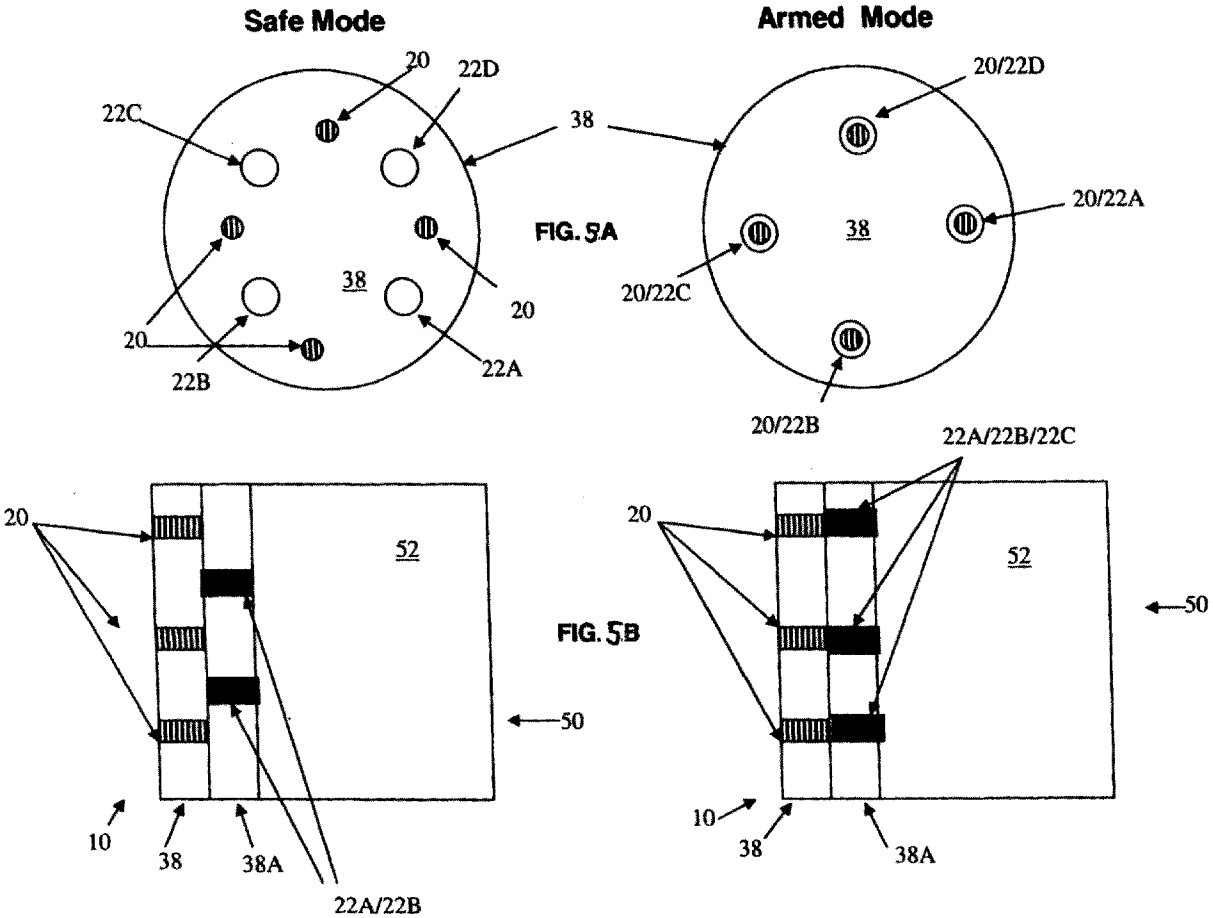
FIG. 5 illustrates another exemplary embodiment of a booster with multi-point initiation in a safe and armed mode.

Yet, another exemplary embodiment is for all booster lead segments 22A/B/C/D to be contact with booster charge 52 but smaller than its failure diameter, as illustrated in FIG. 5. The simultaneous detonation of all booster lead segments is required to create coalescing shock waves that can initiate booster charge 52. Each booster segment in disk 38A has a warhead detonator 20 in disk 38 that is out of line when in the Safe Mode, as shown in FIG. 5A for additional protection from accidental initiation of the warhead explosive 50.

When armed, as shown in FIG. 5B, the disks 38 and 38A are rotated so that the detonators are in line with and can directly initiate the leads. As illustrated in exemplary embodiment in FIG. 6, disks 38 and 38A may have the detonators and lead segments always aligned if those detonators are slappers, which contain no explosive and require a high-energy electrical pulse to vaporize a metallic conductor that drives a small disk into the end of the booster lead segment. Such a detonator will not function from hazards, such as fragments from another warhead. The process for initiating booster charge 52 by the exemplary embodiments in FIGS. 5 and 6 is summarized in FIG. 7.

An example of an exemplary embodiment may be incorporated in fuse mechanisms that have additional safe arming features, such as multiple point initiation systems.

EXAMPLE 1

Prophetic

A booster lead is formed of 4 equal pie-shaped sections. The booster lead is composed of CL-14, and has a diameter of three-fourth of an inch. Each pie-shaped section has a width of one-half the diameter of the booster lead, or three-eighths of an inch. As the failure diameter of CL-14 is slightly less than one-half inch, the booster lead is effectively armed when the pie-shaped sections are combined.

The foregoing summary, description, and examples of the present invention are not intended to be limiting, but are only exemplary of the inventive features which are defined in the claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A weapons system having a warhead fuse for preventing an accidental explosive event of a warhead, the weapons system comprising:

a warhead explosive;

a warhead detonator being effective for detonating the warhead explosive;

a plurality of booster lead segments being situated between the warhead detonator and the warhead explosive, wherein the plurality of booster lead segments are configured to be combined into a single, combined booster lead, wherein each of the plurality of booster lead segments in a safe mode comprises a first configuration with a specific first cross-sectional area, which is less than a second cross-sectional area of a second configuration in an armed mode, where the second configuration is formed by a combination of said each of said plurality of booster lead segments, in order to permit an operational explosive event of the warhead explosive; and, a booster lead separating device for separating said each of the plurality of booster lead segments from each other and effective for preventing formation of the second configuration, wherein each of the plurality of booster lead segments are individual and separate shaped segments where separation from each other in the safe mode prevents a transfer and a propagation of energy from the warhead detonator into the warhead explosive until the individual and separate shaped segments are combined to form the second configuration, and wherein the second configuration comprises joining and abutting said plurality of booster lead segments in the armed mode to permit initiation of the warhead explosive.

2. The weapons system of claim 1, wherein the plurality of booster lead segments comprises from about 2 to 10 booster lead segments.

3. The weapons system of claim 1, wherein the plurality of booster lead segments comprises from about 2 to 6 booster lead segments.

4. The weapons system of claim 1, wherein the plurality of booster lead segments comprises from about 2 to 4 booster lead segments.

5. The weapons system of claim 1, wherein the plurality of booster lead segments are configured to longitudinally abut each other along a surface.

6. The weapons system of claim 5, wherein said surface is a planar surface for abutting another of said plurality of booster lead segments.

7. The weapons system of claim 5, wherein said each of the plurality of booster lead segments comprising shape configurations selected from at least one of a pie shape, a square, and a rectangle.

8. The weapons system of claim 1, wherein the plurality of booster lead segments comprise a pie shape.

9. The weapons system of claim 1, wherein the booster lead separating device comprises a tensioning device.

10. The weapons system of claim 9, wherein the tensioning device is selected from at least one of springs, pistons, and solenoids.

11. The weapons system of claim 1, wherein the booster lead separating device comprises a tensioning device, and wherein the tensioning device comprises a spring.

12. The weapons system of claim 11, further comprising a rotating tubular mechanism for merging the plurality of booster lead segments.

13. The weapons system of claim 1 further comprising at least one energy absorbing material situated between the plurality of booster lead segments and the warhead explosive.

14. The weapons system of claim 13, wherein said at least one energy absorbing material comprises separate energy absorbing materials for each of the plurality of booster lead segments.

15. The weapons system of claim 1, wherein the first configuration is a pie shaped configuration.

16. A method for preventing an accidental explosive event of a warhead, comprising:

providing a weapons system comprising a warhead explosive, a warhead fuse comprising a warhead detonator being effective for detonating the warhead explosive, and a plurality of booster lead segments, wherein each of the plurality of booster lead segments in a safe mode comprises a first configuration with a specific first cross-sectional area which is less than a second cross-sectional area of a second configuration in an armed mode, where the second configuration is formed by a combination of each of said plurality of booster lead segments, in order to permit an operational explosive event of the warhead explosive, wherein each of the plurality of booster lead segments are individual and separate shaped segments where separation from each other in the safe mode prevents a transfer and a propagation of energy from the warhead detonator into the warhead explosive until the individual and separate shaped segments are combined to form the second configuration, and wherein the second configuration comprises joining and abutting said plurality of booster lead segments in the armed mode to permit initiation of the warhead explosive, and wherein the booster lead separating device separates said each of the plurality of booster lead segments from each other, and maintaining a position of the plurality of booster lead segments using the booster lead separating device for preventing formation of the second configuration, wherein a detonation of any of the plurality of booster lead segments fails to provide an energy transfer to the warhead explosive for warhead explosive detonation.

17. The method of claim 16, further comprising combining the plurality of booster lead segments for forming a combined booster lead grouping, wherein the combined booster lead grouping comprises a diameter constituting greater than the failure diameter.

18. The method of claim 17, wherein the step of combining the plurality of booster lead segments occurs within a firing sequence of the warhead explosive.

19. The method of claim 17, wherein the step of combining the plurality of booster lead segments occurs within one minute of the detonation of the warhead explosive, and wherein the step of combining the plurality of booster lead segments occurs within a firing sequence of the warhead explosive.

20. A weapons system having a warhead fuse for preventing an accidental explosive event of a warhead, the warhead fuse comprising:

a warhead explosive;

a warhead detonator being effective for detonating the warhead explosive;

a plurality of booster lead segments being situated between the warhead detonator and the warhead explosive, wherein the plurality of booster lead segments are configured to be combined into a single combined booster lead, wherein each of the plurality of booster lead segments in a safe mode comprises a first dimension, which is a first thickness, that constitutes less than a second dimension, which is a second thickness, formed by a combination of each of said plurality of booster lead segments, in an armed mode, in order to permit an operational explosive event of the warhead explosive, wherein each of the plurality of booster lead segments are individual and separate shaped segments where separation from each other in the safe mode prevents a transfer and a propagation of energy from the warhead detonator into the warhead explosive until the individual and separate shaped segments are combined to form the second dimension, and wherein the second dimension comprises joining and abutting said plurality of booster lead segments in the armed mode to permit initiation of the warhead explosive; and a booster lead separating device for separating each of the plurality of booster lead segments from each other and effective for preventing formation of the second dimension.

* * * * *